US005568775A

United States Patent [19]

Rizzi et al.

[11] Patent Number: 5,568,775

[45] Date of Patent: Oct. 29, 1996

[54] ARTICULATING TABLE CONNECTION

[75] Inventors: John J. Rizzi, Weston, Conn.; Walter C. Mrotz, III, North Muskegon, Mich.

[73] Assignee: Knoll, Inc., East Greenville, Pa.

[21] Appl. No.: 376,989

[22] Filed: Jan. 23, 1995

[51] Int. Cl.[6] ..... A47B 57/20

[52] U.S. Cl. ..... 108/64; 108/66; 108/65; 108/68; 108/69; 403/61; 248/558

[58] Field of Search ..... 108/64, 65, 66, 108/68, 69; 403/61, 80, 87, 116, 208, 286; 248/558

[56] References Cited

U.S. PATENT DOCUMENTS

| | | | |
|---|---|---|---|
| 3,714,906 | 2/1973 | Finestone | 108/64 |
| 4,158,335 | 6/1979 | Belcastro | 108/64 |
| 4,665,836 | 5/1987 | Burr | 108/64 |
| 4,915,034 | 4/1990 | Grabe et al. | 108/65 |
| 5,078,055 | 1/1992 | Bellini et al. | 108/64 |
| 5,146,855 | 9/1992 | Morgan | 108/64 |
| 5,182,996 | 2/1993 | Gutgsell | 108/64 |
| 5,341,750 | 8/1994 | Fuchs | 108/64 |

FOREIGN PATENT DOCUMENTS

| | | | |
|---|---|---|---|
| 1463176 | 12/1966 | France | 108/64 |
| 2232179 | 12/1974 | France | 108/66 |
| 142914 | 6/1990 | Japan | 403/61 |

*Primary Examiner*—Peter M. Cuomo
*Assistant Examiner*—Rodney B. White
*Attorney, Agent, or Firm*—Buchanan, P.C. Ingersoll; Carla J. Vrsansky

[57] ABSTRACT

An articulating table connection or arrangement includes an in-fill piece occupying a gap between spaced tables and remaining in abutment with the tables as the tables are relatively aligned at any angle around a center defined by a curved arc segment at an edge of at least one of the table tops. At least one of the tables when viewed as a whole in plan is non-circular and preferably C-shaped or kidney shaped, but has a portion of an edge that defines a circularly curved arc segment along a limited distance. The in-fill piece has a complementary shaped edge abutting the arc segment. The in-fill piece carries brackets which stabilize the in-fill piece and tables in such relative positions that the upper surfaces of the tables and in-fill piece occupy a common plane. The brackets further couple the tables and in-fill piece together for relative movement at least so that the complementary edge of the in-fill piece is pivotable relative to the arc segment of the table.

11 Claims, 3 Drawing Sheets

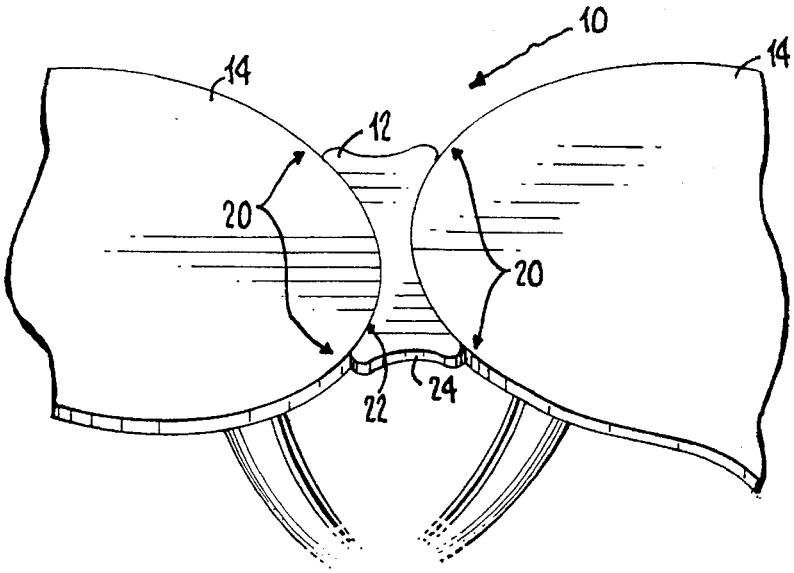
FIG. 1.
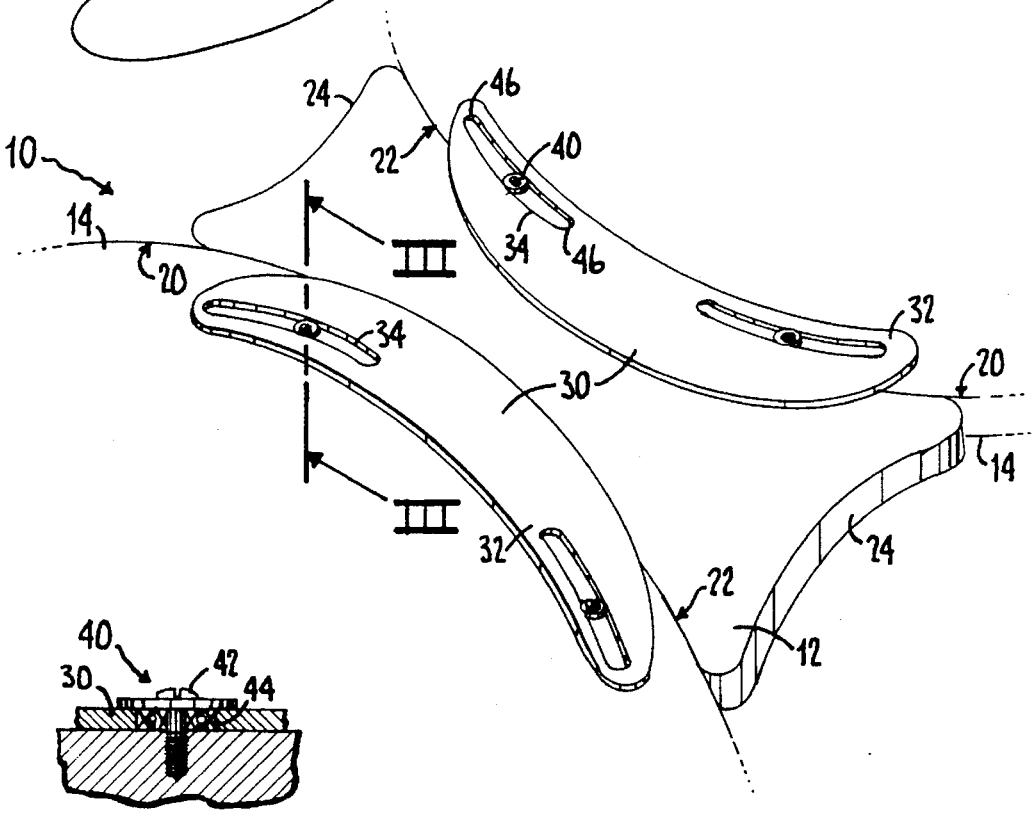
FIG. 3.
FIG. 2.

ARTICULATING TABLE CONNECTION

BACKGROUND OF THE INVENTION

1. Field of the Invention

The invention relates to an in-fill structure for joining and continuing the upper planar surfaces of adjacent tables or counters, particularly irregularly shaped tables, which provides for articulation whereby the tables can be arranged over a range of relative positions defining different configurations. In particular, the invention concerns joining a kidney shaped table having differing radii of curvature around its periphery to another table that may also be kidney shaped.

2. Prior Art

It is popular to furnish homes and offices with irregularly shaped furniture such as tables. It is also functionally efficient to arrange work surfaces to partly surround a person's work area, providing work surfaces within easy reach. Such an arrangement may advantageously define an L-shape, a C-shape, a U-shape, etc. The user typically sits on the inner side. A single integral table can define such a shape, or two or more tables can be placed adjacent one another to form the desired shape.

A single table or desk that is kidney shaped in plan view forms a C-shape that has the advantage of partly surrounding a user on the concave side of the C-shape. The upper or working surface of the table or desk is closer to the user than with a regularly shaped table (e.g., rectangular or round) because the table or desk curves around the user. Such kidney or C-shaped tables and desks are aesthetically popular for design reasons, and also lack sharp corners.

However, the C-shape or kidney shape is inherently disadvantageous for joining two or more tables into a larger functional work surface. Whereas rectangular tables can be abutted along their straight edges to get a relatively continuous working surface, the irregular C-shape cannot be abutted against another table without leaving substantial gaps. Although complementary convex and concave sides of two C-shaped tables might be abutted, this would only increase the span across the table and would not form a larger surround for the user. Even that ,arrangement would leave gaps and/or cracks. What is needed is a substantially continuous work surface extending in some form of arc or angle around the user.

Office occupants and the like may be motivated by various reasons to abut two tables together. For example, a person may want an enlarged desk or working surface on which to spread out. A "partners" desk arrangement may be desirable, in which the enlarged desk or working surface is shared with a fellow occupant. In a "partners" arrangement, the two persons may sit either aside one another or on opposite sides of the abutted tables.

C-shaped tables for such arrangements are abutted at their ends (the top or bottom of the C), which generally form a convex arc. Thus the tables cannot be abutted to form a continuous surface, instead being abutted only along a single point where the convex curved surfaces touch. The workspace at the abutment is no more useful than if the tables were separated. Articles cannot be slid from one table to the other without catching or falling into a crack or gap.

It is known, for example, from U.S. Pat. No. 5,146,855—Morgan, to link together two or more circular tables with a connecting structure whose upper surface is coplanar with the circular table tops. The connecting structure is complementary to the circumference of the tables and extends around the table by 60 to 90 degrees of arc. The angular arrangement of the table is irrelevant because the table is circular. The connecting structures at 90 or 60 degrees allow a plurality of tables to be coupled either in rectilinear arrays or at an angle. The arrays are fixed in position by abutment of the ends of the connecting structures. It would be advantageous if the angular arrangement of linked tables could be varied to enable the user to set the tables at any angle desired in an array, at least within a range.

The problem of linking C-shaped or kidney shaped tables is more complicated than linking circular tables. As the relative angle of a C-shaped table is changed, the radius of curvature changes. For example, proceeding from an end (which defines a substantially circular arc) toward the convex side of the C-shape, the radius of curvature increases. Therefore, a connector as in the Morgan circular table arrangement must be arranged for a particular position on the table to be complementary to the edge of the table, and if moved away from that position causes a gap to open between the connector and the table. For C-shaped tables and the like, this limits the two linked tables to a given relative angle, just as with Morgan's circular tables.

It would be advantageous to provide a means for linking non-circular tables together in an arrangement that provides a continuous span between the respective working surfaces and also permits relative movement such that the relative positions of the tables can be changed. It would also be advantageous if this could be accomplished without running afoul of the changing radius of curvature of a C-shaped table.

SUMMARY OF THE INVENTION

It is an object of the invention to provide an articulating table arrangement that includes at least one non-circular, non-rectangular table, another table, and an in-fill connector piece occupying a gap between the tables and continues the table top surface across the gap.

It is another object of the invention to provide an articulating table arrangement in which the at least one non-circular, non-rectangular table includes a limited portion of an edge which defines a segment of an arc. The in-fill piece is reciprocally-shaped to have an edge portion complementary to abut the arc segment portion of the table.

It is another object of the invention to provide the above articulating table arrangement with brackets that movably connect the in-fill piece and non-circular table such that the in-fill piece effectively pivots about a radius center defined by the are segment.

It is an additional object of the invention to configure the above articulating table arrangement for two same sized C-shaped tables which are arrangeable in, among other arrangements, E-shaped, C-shaped and/or S-shaped arrangements.

It is still another object to define a span of articulation that is limited to abutment of the in-fill piece to a substantially circular section of arc.

These and other aspects and objects are provided according to the invention in an articulating table connection or arrangement comprising a pair of tables and an in-fill piece occupying a gap between the tables. At least one of the tables is non-circular but has at least one edge portion that defines an arc segment. The in-fill piece has an edge portion shaped as a mirror opposite or complement of the arc segment on the non-circular table and another edge portion shaped to abut flush against an edge of the other table.

The in-fill piece and tables each define upper or working surfaces, and are connected together by brackets such that the respective upper surfaces occupy a common plane so that a common working surface extends between the tables across the in-fill piece.

One of the brackets provides an articulating joint between the non-circular table and the in-fill piece. The in-fill piece is connected for movement relative to the in-fill piece such that the mirror opposite edge portion of the in-fill piece is shiftable through a limited range of complementary alignments with the arc segment edge portion of the non-circular table.

Preferably that one bracket includes stop surfaces which act to limit the range of relative movement between the in-fill piece and the non-circular table. Thus the aforementioned aspects of the invention govern the relative movement between the in-fill piece and non-circular table such that the in-fill piece is effectively pivotable relative to the non-circular table about a radius center defined by the arc-segment edge portion.

In a preferred embodiment of the invention, both tables have C-shaped upper or working surfaces, wherein the subject edge portions define convex arc segments in two opposite places. The in-fill piece has spaced complementary or reciprocally shaped edge portions that therefore are concave. Accordingly, the tables and in-fill piece are selectively positionable in line, in a C-shaped arrangement, and/or in an S-shaped arrangement, including relative angular positions in between the available extremes.

Preferably the brackets comprise two opposite separate members that are attached rigidly to the in-fill piece. However the brackets might optionally be realized as a single bracket member, or can be formed integrally with the in-fill piece. The brackets preferably define opposite flanges extending out from the in-fill piece for residing under the edges of two table tops to be linked and positioning the top surface of the in-fill piece coplanar with the table tops. The flanges have curved slots along a line in a circle coaxial with a circle in which the outer edges of the in-fill piece reside, which outer edges are complementary to the periphery of the table tops over a range of displacement defined by the slots. The table tops have undersides to which spaced guide pins are affixed. The spaced guide pins extend through the curved slots in the flanges to couple the in-fill piece and the respective the tables, via the flanges.

The size and shape of the slots govern the relative movement between the tables and the in-fill piece, and therefore determine the extent to which the tables can be angled. The curved slots have opposite ends which define stop surfaces for the guide pins, and limit the range of relative movement to the defined stops.

Optionally, only one of the tables may have a curved edge as characteristic of a kidney or C-shaped table. For example, a table having a round edge can be coupled to a rectangular table having a straight edge. To this end, the in-fill piece is accordingly modified, such that it is given a linear edge for abutting the rectangular table, and preferably straight slots parallel to the straight edge, for relative movement.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings, FIG. 1 is a perspective view of an articulating table connection in accordance with the invention, wherein an in-fill piece occupies a gap between a pair of C-shaped tables, which tables are partly broken away.

FIG. 2 is an enlarged bottom perspective view.

FIG. 3 is an enlarged partial section view taken along line III—III in FIG. 2.

Figure 4:
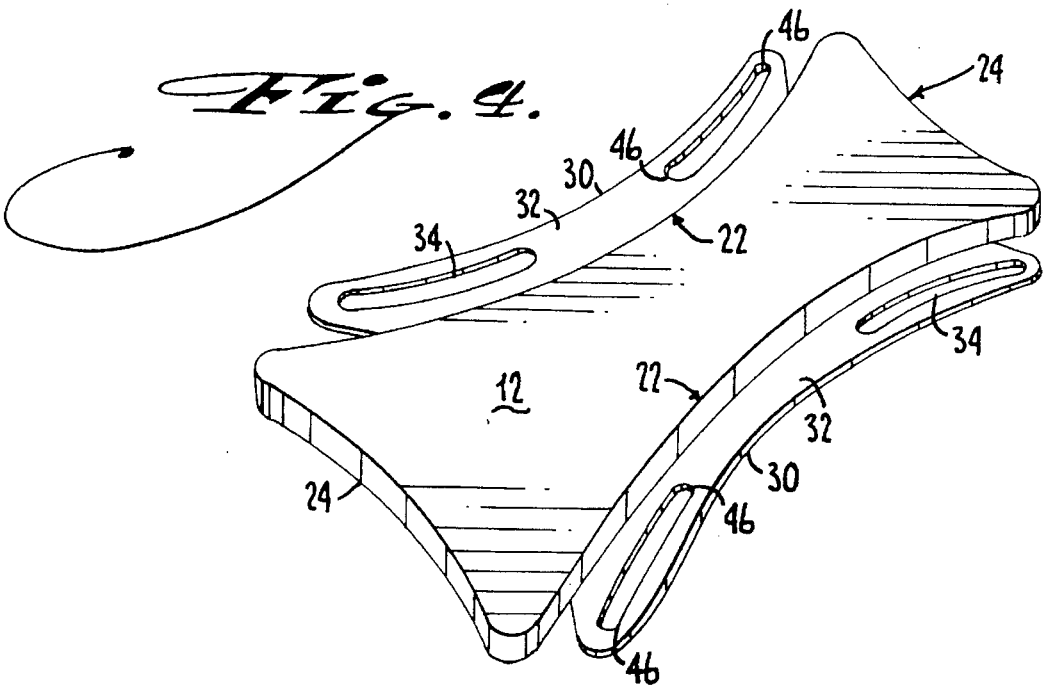
FIG. 4 is a top perspective view corresponding to FIG. 2, except that the in-fill piece is shown in isolation.

FIGS. *7a–7c* are top plan views depicting various relative positions which are possible with the articulating table connection of FIG. 1, wherein FIG. *7a* depicts the C-shaped tables arranged in straight line alignment, FIG. *7b* depicts the C-shaped tables arranged in a C-shaped alignment, and FIG. *7c* depicts the C-shaped tables arranged in an S-shaped alignment.

DETAILED DESCRIPTION OF THE PREFERRED EMBODIMENTS

In FIG. 1, an articulating table connection or arrangement 10 in accordance with the invention comprises an in-fill piece 12 occupying a gap between a pair of spaced tables 14. As shown in FIGS. *7a–7b*, the tables 14 are relatively C-shaped or kidney shaped in plan view. When considered as a whole, the tables 14 have upper surfaces which are non-circular. Yet the tables 14 have edge portions that define a limited arc segment 20 at which the radius of curvature is constant. The radii of curvature of the two tables can be the same, for example as in FIG. 1, such that the in-fill piece is symmetrically hourglass shaped. Alternatively, the radii can be different.

The in-fill piece 12 is positioned in the gap such that the respective upper surfaces of the tables 14 and in-fill piece 12 are arranged in a common plane. The in-fill piece 12 is shaped and sized to span a limited portion of the gap between the tables 14 to provide a flush working surface that extends from one table 14 to the other, across the in-fill piece 12. Thus the in-fill piece connects the tables while continuing and joining together their work surfaces.

Advantageously, the in-fill piece only minimally spaces the tables apart, and extends for a substantial depth across the shorter dimension of the tables. Thus as shown in FIG. 1, the in-fill piece 12 has spaced long edges 22 extending between opposite short edges 24. Other relative sizes are also possible. The long edges 22 in FIG. 1 are formed as opposite concave curves 22 that are complementary to the arc segments 20 of the tables 14 in the area of abutment. The concave curves 22 of the in-fill piece 12 are not as long as the arc segments 20 of the tables 14. That is, the concave curves 22 of the in-fill piece 12 extend over less of an arc-radian than the arc segment 20 of the tables 14. As a result, the in-fill piece can be displaced along segments 20, for a distance along which the radii of curvature of the arc segments remains substantially the same. Thus the tables remain substantially abutted against the in-fill piece as the relatively smaller arc of the concave curves 22 of in-fill piece 12 are shifted along table 14 through a limited range. This range defines the range of alignments at which the tables can be placed.

FIG. 2 is a view from the underside of the tables and shows that the in-fill piece 12 is connected between the tables 14 by a pair of opposite brackets 30. These brackets 30 mechanically support the body of the in-fill piece and govern the relative movement between the in-fill piece 12 and tables 14. In the embodiment shown, each bracket 30 is shaped as a wedge-shaped section of an annulus. The brackets 30 are rigidly affixed to an underside of the in-fill piece 12 by screw fasteners. As FIG. 4 shows, the in-fill piece 12 carries the affixed brackets 30 such that the brackets 30 define flange portions 32 that extend away from the in-fill piece 12, which is of a thickness equal to that of the table tops. The flanges 32 occupy locations relative to the in-fill piece 12 in which they can be abutted under adjacent marginal portions of the undersides of the tables 14, as shown in FIG. 2. It will be appreciated that the specific structures are subject to some variation. For example, it is also possible to form the flanges integrally with the in-fill piece, to shape the flanges differently or to use a spacing arrangement that positions an in-fill piece that is not as thick as the table tops such that the upper surfaces are coplanar.

As shown in FIG. 2, the flanges 32 are formed with a pair of curved openings or slots 34. The undersides of the tables 14 carry a set of guide pins 40 which are located to extend through the slots 34 as shown. FIG. 3 shows that the guide pins 40 can comprise a round-headed screw 42 extending through a collar 44 placed in the slot 34 and tightened into the table 14 from the underside. The collar 44 functions as a bearing and is made from an appropriate material such as a polymer or beryllium bronze or the like. The round-head of the screw 42 has marginal portions which project over a washer that extends in turn beyond a periphery of the collar 44 for holding the flange against the table top, i.e., constraining the flange 32 to occupy a plane adjacent the underside of the table 14.

The flanges 32, as shown by FIG. 2, are permitted limited movement in that plane, which limited movement is governed by the guide pins 40 in the curved openings 34. The curved openings 34 are arranged on the perimeter of a circle that is coaxial with the arc segments 20 of the tables 14. Thus the guide pins 40 in the curved openings 34 couple the in-fill piece 12 and tables 14 together, and govern and limit their relative movement as will be described with reference to FIGS. 7*a* and 7*b*.

Figures 7A, 7B, 7C:
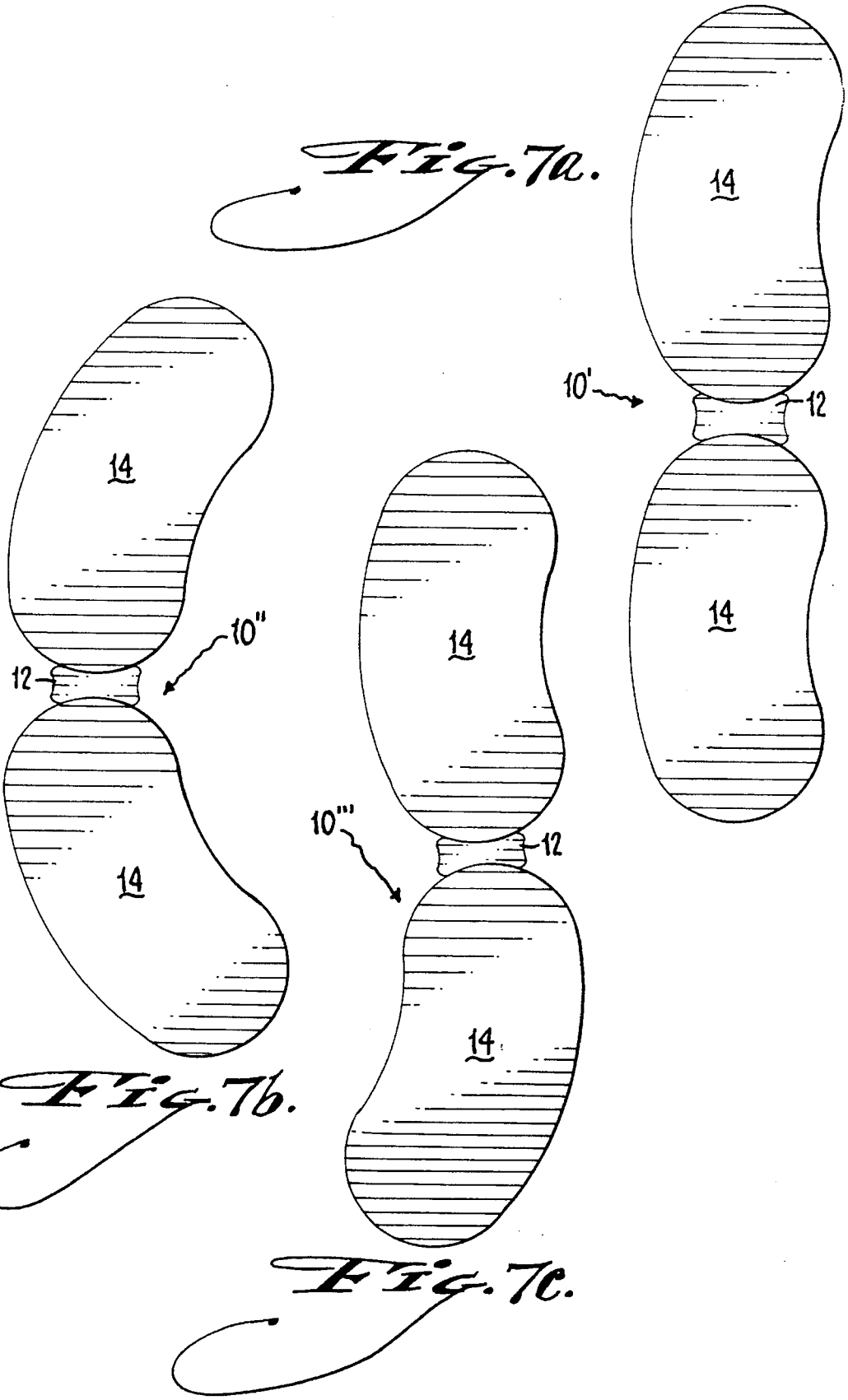

In general, the concave curve portion 22 of the in-fill piece 12 is shiftable relative to the arc segment portion of the tables 14 through a limited range of alignments in which the in-fill piece remains abutted against the edge of the tables. The range of limited alignments is limited by curved openings 34, which have ends 46 (e.g., see, FIGS. 2 or 4) against which the guide pins 40 stop. FIG. 7*a* shows two C-shaped tables 14 arranged in an in-line arrangement 10'. In FIG. 7*b*, the tables 14 have been shifted relative to the in-fill piece to define a C-shaped arrangement 10" FIG. 7*c* shows an another arrangement 10''' between the C-shaped tables 14, as arranged in an S-shaped arrangement.

Each arrangement 10 is shiftable by a user as desired and can be set at any point between the extremes defined by the opposite ends of openings 34. The arrangements 10' and 10''' in FIGS. 7*a* and 7*c* are desirable as stylized variations of "partners" desks, in which two users are provided with workspace. FIG. 7*b* shows how two C-shaped tables 14 can be coupled to provide a single, enlarged C-shaped workspace for a single user. Of course with additional in-fill pieces the arrangement could be expanded to three or more tables.

The tables 14 and in-fill piece 12 can be secured in fixed positions, if desired, by making the collar 44 somewhat thinner than the flange, which permits clamping of the flange by further tightening of the screws 42. However even without such tightening, the tables can be expected to remain stable in the arrangement where they are left, absent an impact or the like, because of the combined inertia of the tables 14 and in-fill piece 12.

Figure 5:
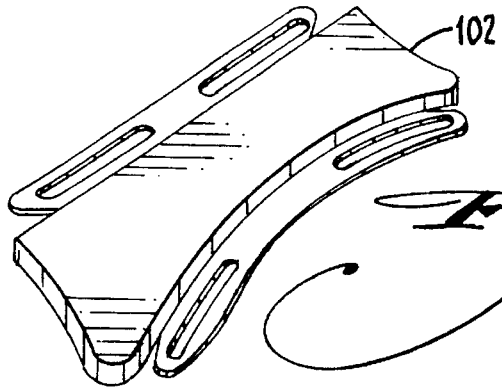
FIG. 5 is a reduced-scale top perspective view of an alternative embodiment of the in-fill piece.
Figure 6:
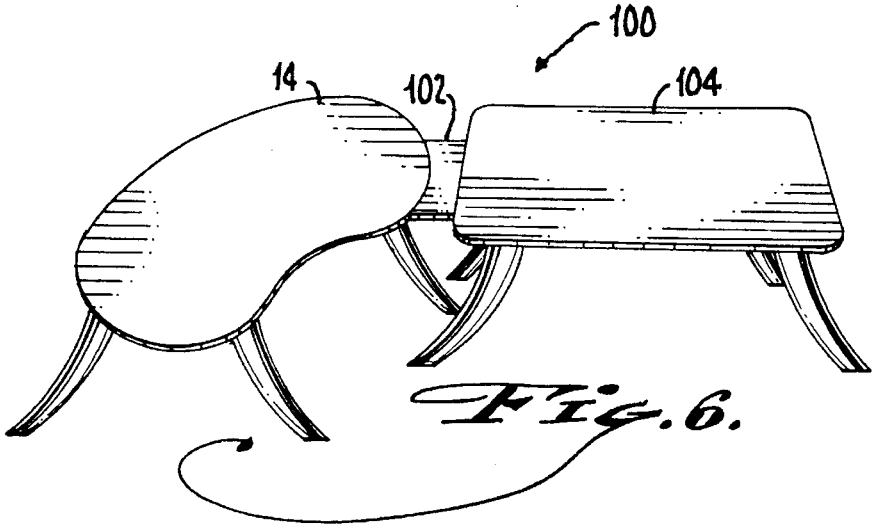
FIG. 6 is a reduced-scale top perspective view of the FIG. 5 in-fill piece occupying a gap between one C-shaped table and another, generally rectangular table.

The exemplary arrangements 10 in FIGS. 7*a*–7*c* shown are selected merely for convenience in this description and are not intended to the invention to a particular table 14, in-fill piece 12, or dual table configuration. As discussed above the two tables can have different radii of curvature. With reference to arrangement 100 in FIG. 6, an alternatively-shaped in-fill piece 102 (shown in FIG. 5) can be provided in the gap between one C-shaped table 14 and a generally rectangular table 104 having a straight edge. It is also possible to reverse the connection order of the parts, for example with the flanges attached rigidly to the tables and the guide slots and pins permitting displacement of the flanges relative to the in-fill piece instead of relative to the tables.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A table arrangement comprising;

at least two tables having a first table and a second table, each table including a top having an upper surface, said first table having an edge defining a curved. arc segment over a part of a periphery of the top of said first table;

an in-fill piece having one edge portion shaped to complement the edge of said first table along the arc segment, and an opposite edge portion shaped to complement an edge of the second table wherein the in-fill piece has an upper surface and wherein the upper surfaces of said first table, said second table and said in-fill piece occupy a common plane;

bracket means for connecting the in-fill piece and the first and second tables together such that the in-fill piece spans a gap between the tables and abuts the edges of the tables;

said bracket means including articulating means for coupling said first table and the in-fill piece together for relative movement while in abutment, said articulating means comprising a flange extending from the in-fill piece to lap the edge of said first table, the flange having curved openings for receiving spaced guide pins mounted to said first table to couple the first table and the in-fill piece together for relative movement through a limited range of complementary alignments.

2. The table arrangement of claim 1, wherein the curved openings have opposite ends which define stop surfaces for the guide pins, said stop surfaces limiting the range of relative movement between defined stops.

3. The table arrangement of claim 2, wherein the first table is irregularly shaped and the edge has a substantially circular configuration along a limited length at the arc segment, the curved openings and the arc segment being disposed along coaxial circles.

4. The table arrangement of claim 3, wherein the first table is kidney shaped and the arc segment is disposed at one end of the first table.

5. The table arrangement of claim 3, wherein the second table has a different radius of curvature than the arc segment and is attached to the opposite edge portion of the in-fill piece by a corresponding flange and guide pins matched to said different radius of curvature.

6. The table arrangement of claim 3, wherein the first and second tables have arc segments of equal radii of curvature and wherein the opposite edge portions of the in-fill piece are mirror image opposites.

7. The table arrangement of claim 3, wherein the flange is rigidly affixed to the in-fill piece and the guide pins are attached to an underside of the top of the first table.

8. The table arrangement of claim 1, wherein the arc segment forms a convex edge.

9. The table arrangement of claim 1, wherein the bracket means comprises a pair of brackets, and the pair of brackets and in-fill piece are separate components which are fixed together as an assembly.

10. The table arrangement of claim 1, wherein the tables are C-shaped and are arrangeable in C-shaped alignment, in-line alignment and S-shaped alignment.

11. The table arrangement of claim 10, wherein the tables are freely movable to any alignment in a range between the in-line alignment and one of the C-shaped and S-shaped alignments, by displacement relative to the in-fill piece and one another, around a center corresponding to the arc segment.

* * * * *